US005823840A

United States Patent [19]

Powers

[11] Patent Number: 5,823,840

[45] Date of Patent: Oct. 20, 1998

[54] EMERGENCY FLOTATION DEVICE

[76] Inventor: William C. Powers, 2352 Locust Road, Columbia, S.C. 29223

[21] Appl. No.: 897,926

[22] Filed: Jul. 21, 1997

[51] Int. Cl.[6] ..... B63C 9/16

[52] U.S. Cl. ..... 441/122; 441/98; 441/88

[58] Field of Search ..... 441/80, 88, 93–101, 441/122, 123

[56] References Cited

U.S. PATENT DOCUMENTS

| | | | |
|---|---|---|---|
| 3,084,357 | 4/1963 | Gaumer | 9/327 |
| 4,482,081 | 11/1984 | Meggs | 225/5 |
| 4,629,436 | 12/1986 | Stewart et al. | 441/93 |
| 4,810,219 | 3/1989 | Anderson et al. | 441/80 |
| 4,813,899 | 3/1989 | Fujimoto | 441/122 |

*Primary Examiner*—Ed L. Swinehart
*Attorney, Agent, or Firm*—Joseph N. Breaux

[57] ABSTRACT

An emergency flotation device securable about the wrist of a user that includes a bracelet assembly including an upper bracelet member and a lower bracelet member that are attached by a flexible bracelet member hinge, that are pivotable into a closed position forming a wrist receiving opening, and that are securable in the closed position by a bracelet member latch; a scored flotation balloon retaining membrane positioned over a flotation balloon deployment window of the upper bracelet member; a valve assembly having a valve intake, a valve outlet and a manually activated valve positioned between the valve intake and the valve outlet; a resilient bladder filled with a pressurized acid solution; a flexible connecting tube in connection between the resilient bladder and the valve intake; an inflatable flotation balloon positioned within the flotation balloon receiving compartment of the upper bracelet member, the inflatable flotation balloon having a balloon chamber having a supply of carbon dioxide generating material; and an acid solution delivery tube in connection between the valve outlet and the balloon chamber of the inflatable flotation balloon.

12 Claims, 3 Drawing Sheets

EMERGENCY FLOTATION DEVICE

TECHNICAL FIELD

The present invention relates to emergency flotation devices and more particularly to an emergency flotation device that is securable about the wrist of a user and that includes a bracelet assembly including an upper bracelet member and a lower bracelet member that are attached by a flexible bracelet member hinge, that are pivotable into a closed position forming a wrist receiving opening, and that are securable in the closed position by a bracelet member latch, the upper bracelet member having a flotation balloon storage compartment formed therein in connection with a flotation balloon deployment window, the lower bracelet member having a bladder receiving compartment formed therein; a scored flotation balloon retaining membrane positioned over the flotation balloon deployment window of the upper bracelet member; a valve assembly having a valve intake, a valve outlet and a manually activated valve positioned between the valve intake and the valve outlet; a resilient bladder filled with a pressurized acid solution, the resilient bladder being positioned within the bladder receiving compartment of the lower bracelet member; a flexible connecting tube in connection between the resilient bladder and the valve intake; an inflatable flotation balloon positioned within the flotation balloon receiving compartment of the upper bracelet member, the inflatable flotation balloon having a balloon chamber having a supply of carbon dioxide generating material positioned therein; and an acid solution delivery tube in connection between the valve outlet and the balloon chamber of the inflatable flotation balloon. The term "carbon dioxide generating material" is used herein to mean a material, such as calcium carbonate or sodium bicarbonate, that reacts with the acid solution to release quantities of carbon dioxide gas.

BACKGROUND OF THE INVENTION

Boaters and other individuals that are close to bodies of water find it beneficial to wear flotation devices to guard against the possibility of drowning should they accidentally become immersed in the water. Although wearing a flotation device provides increased safety, many individuals forgo the benefits of such flotation devices because the flotation devices hinder recreational and work activities. It would be a benefit, therefore, to have an emergency flotation device that was small and that could be worn without greatly hindering the activities of the wearer. It would be a benefit to have an emergency flotation device that could be secured about the wrist of the user. In order to minimize size of the emergency flotation device it would be a benefit to have an emergency flotation device of the type described that included a flotation balloon that was inflatable by a gas. Because compressed gas cartridges can be dangerous, it would be a further benefit if the inflatable flotation balloon was inflated by a chemically generated gas.

SUMMARY OF THE INVENTION

It is thus an object of the invention to provide an emergency flotation device that is of a size small enough to be worn without greatly hindering the activities of the wearer.

It is a further object of the invention to provide an emergency flotation device that is securable about the wrist of the user.

It is a still further object of the invention to provide an emergency flotation device that includes a flotation balloon that is inflatable by a gas.

It is a still further object of the invention to provide an emergency flotation device that includes a chemical gas generating system and an inflatable flotation balloon that is inflated by the chemically generated gas.

It is a still further object of the invention to provide an emergency flotation device that includes a bracelet assembly including an upper bracelet member and a lower bracelet member that are attached by a flexible bracelet member hinge, that are pivotable into a closed position forming a wrist receiving opening, and that are securable in the closed position by a bracelet member latch, the upper bracelet member having a flotation balloon storage compartment formed therein in connection with a flotation balloon deployment window, the lower bracelet member having a bladder receiving compartment formed therein; a scored flotation balloon retaining membrane positioned over the flotation balloon deployment window of the upper bracelet member; a valve assembly having a valve intake, a valve outlet and a manually activated valve positioned between the valve intake and the valve outlet; a resilient bladder filled with a pressurized acid solution, the resilient bladder being positioned within the bladder receiving compartment of the lower bracelet member; a flexible connecting tube in connection between the resilient bladder and the valve intake; an inflatable flotation balloon positioned within the flotation balloon receiving compartment of the upper bracelet member, the inflatable flotation balloon having a balloon chamber having a supply of calcium carbonate or baking soda positioned therein; and an acid solution delivery tube in connection between the valve outlet and the balloon chamber of the inflatable flotation balloon.

It is a still further object of the invention to provide an emergency flotation device that accomplishes some or all of the above objects in combination.

Accordingly, an emergency flotation device is provided that includes a bracelet assembly including an upper bracelet member and a lower bracelet member that are attached by a flexible bracelet member hinge, that are pivotable into a closed position forming a wrist receiving opening, and that are securable in the closed position by a bracelet member latch, the upper bracelet member having a flotation balloon storage compartment formed therein in connection with a flotation balloon deployment window, the lower bracelet member having a bladder receiving compartment formed therein; a scored flotation balloon retaining membrane positioned over the flotation balloon deployment window of the upper bracelet member; a valve assembly having a valve intake, a valve outlet and a manually activated valve positioned between the valve intake and the valve outlet; a resilient bladder filled with a pressurized acid solution, the resilient bladder being positioned within the bladder receiving compartment of the lower bracelet member; a flexible connecting tube in connection between the resilient bladder and the valve intake; an inflatable flotation balloon positioned within the flotation balloon receiving compartment of the upper bracelet member, the inflatable flotation balloon having a balloon chamber having a supply of calcium carbonate or baking soda positioned therein; and an acid solution delivery tube in connection between the valve outlet and the balloon chamber of the inflatable flotation balloon.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

DESCRIPTION OF THE EXEMPLARY EMBODIMENT

Figure 1:
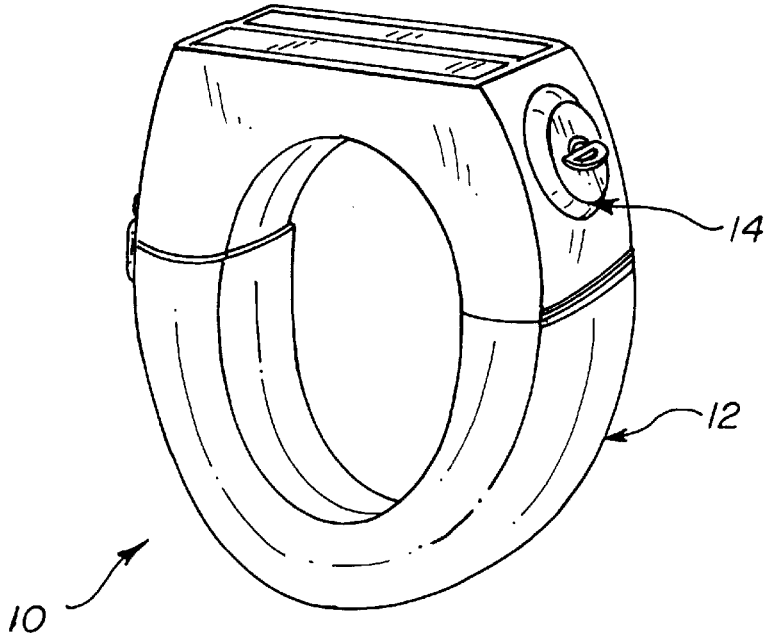
FIG. 1 is a perspective view of an exemplary embodiment of the emergency flotation device of the present invention showing the bracelet assembly including the upper bracelet member, the lower bracelet member, the bracelet member latch and the flexible bracelet member hinge; the pressure activated valve assembly with the manual D-ring actuator; and the scored flotation balloon retaining membrane positioned over the flotation balloon deployment window of the upper bracelet member.
Figure 3:
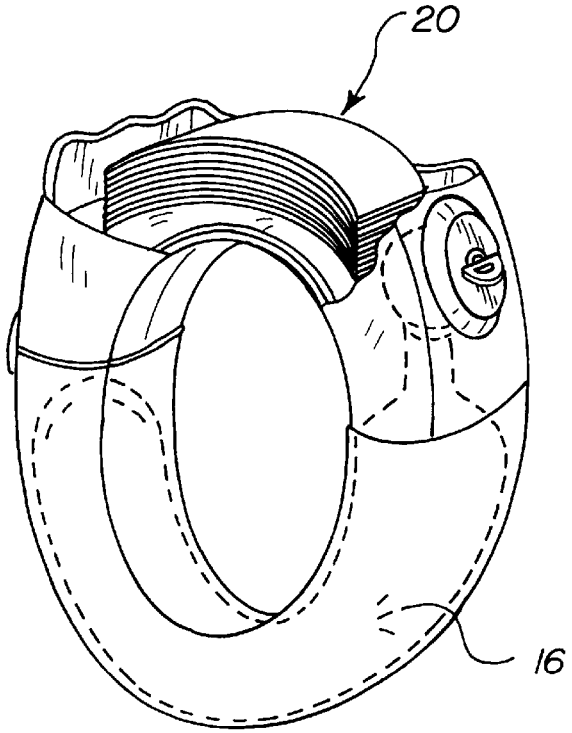
FIG. 3 is a partial cutaway perspective view of the exemplary emergency flotation device of FIG. 1 showing the upper section of the upper bracelet member removed to reveal the folded flotation balloon positioned within the flotation balloon storage compartment.

FIG. 1 shows an exemplary embodiment of the emergency flotation device of the present invention generally designated by the numeral 10. In this embodiment, emergency flotation device 10 includes a bracelet assembly, generally designated 12; a valve assembly, generally designated 14; a resilient bladder, generally designated 16 (FIGS. 2,3,5), filled with a pressurized acid solution 15 (FIG. 5); a flexible connecting tube 18 (FIGS. 2,5); an inflatable flotation balloon, generally designated 20 (FIGS. 3,5,6) , that forms a balloon chamber (FIGS. 5,6) within which a supply of calcium carbonate crystals 23 (FIG. 5) is positioned; and an acid solution delivery tube 24 (FIGS. 5,6) in connection between valve assembly 14 and balloon chamber 22 (FIGS. 5,6) of inflatable flotation balloon 20 (FIGS. 3,5,6).

Figure 2:
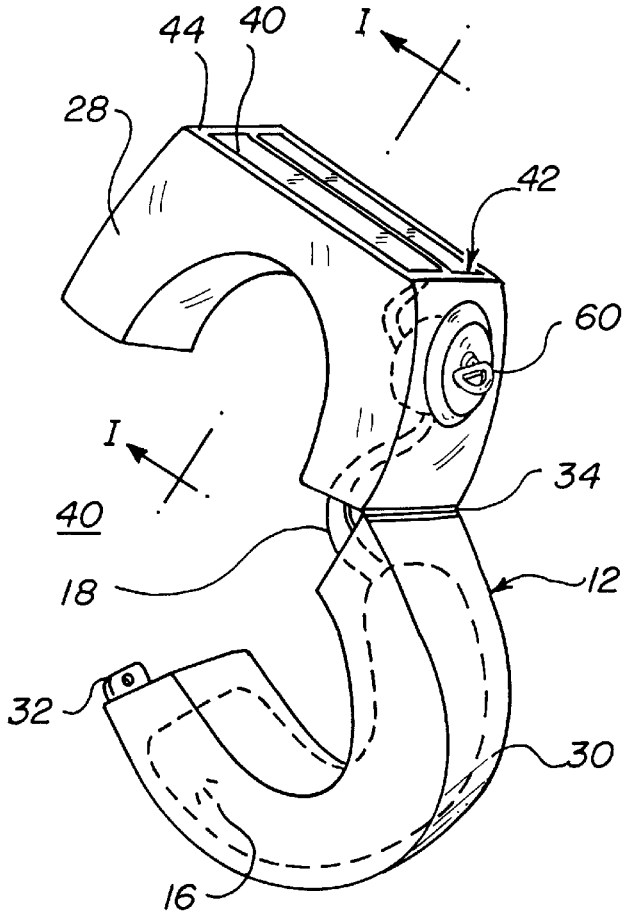
FIG. 2 is a second perspective view of the exemplary emergency flotation device of FIG. 1 showing the upper bracelet member and the lower bracelet member pivoted open at the flexible bracelet member hinge; and the flexible tube connecting the pressure activated valve assembly and the resilient bladder that is filled with the acid solution.
Figure 2A:
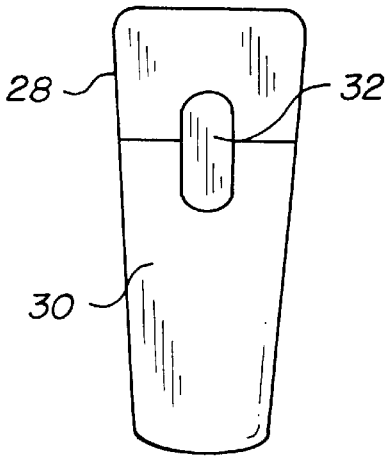
FIG. 2A is a side plan view of the upper and lower bracelet members of the bracelet assembly pivoted into the closed position and locked together with the bracelet member latch.

With reference to FIG. 2, bracelet assembly 12 includes an upper bracelet member 28, a lower bracelet member 30, a bracelet member latch 32 and a flexible bracelet member hinge 34. In this embodiment, upper bracelet member 28, lower bracelet member 30, bracelet member latch 32 and flexible bracelet member hinge 34 are of molded plastic construction. Upper bracelet member 28 and lower bracelet member 30 are pivotable at flexible bracelet member hinge 34 into an open position to provide a gap 40 through which the wrist of a user is inserted. With reference to FIG. 2A, upper bracelet member 28 and lower bracelet member 30 are then pivoted into a closed position and locked in place with conventional snap fit bracelet member latch 32.

Figure 4:
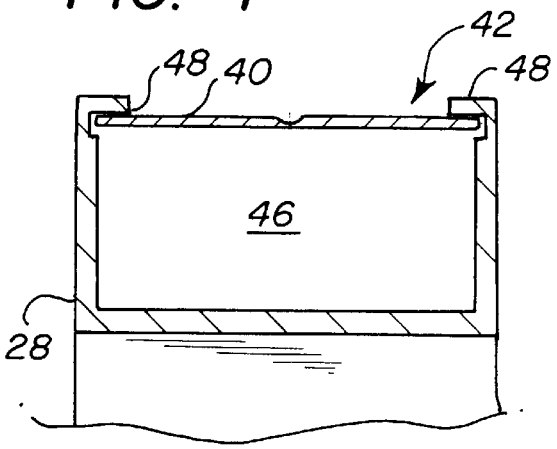
FIG. 4 is a cross-sectional view of the upper bracelet member along the line I—I of FIG. 2 showing the flotation balloon storage compartment with the flotation balloon removed for clarity and the scored flotation balloon retaining membrane positioned over the flotation balloon deployment window.

With reference back to FIG. 2, a scored plastic film, flotation balloon retaining membrane 40 is positioned over a flotation balloon deployment window 42 that is formed through the upper surface 44 of upper bracelet member 28. Balloon retaining membrane 40 provides a barrier, with reference now to FIG. 3, for maintaining a folded inflatable flotation balloon 20 within a flotation balloon storage compartment 46 (FIG. 4). With reference now to FIG. 4, flotation balloon storage compartment 46 is formed within upper bracelet member 28 and in connection with flotation balloon deployment window 42. In this embodiment, balloon retaining membrane 40 is a section of plastic film that is adhesively secured to the lip 48 that defines flotation balloon deployment window 42.

Figure 5:
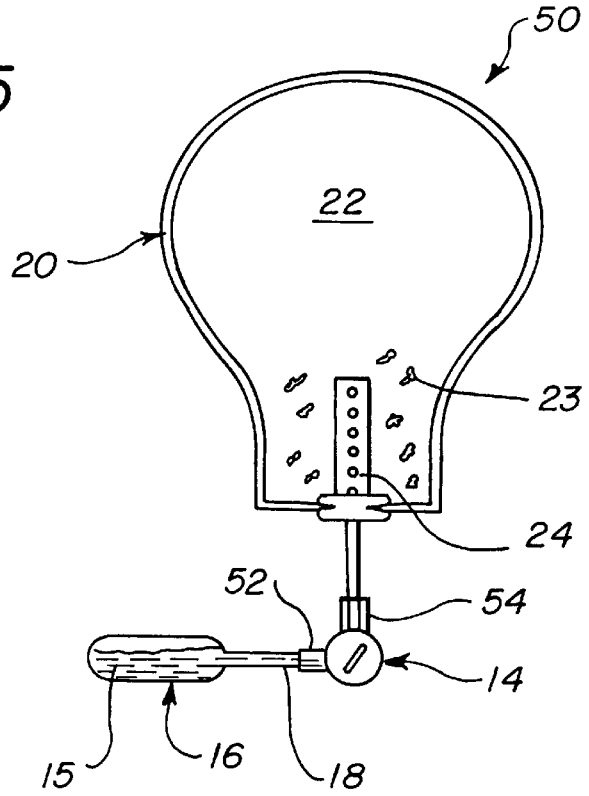
FIG. 5 is a schematic representation of the flotation balloon inflation system of the emergency flotation device of the resent invention showing the resilient bladder filled with the acid solution; the flexible tube connecting the resilient bladder and the pressure activated valve assembly with the manual D-ring actuator; the acid solution delivery tube with a number of distribution orifices positioned within and in sealed relationship with the flexible flotation balloon; and the baking soda (calcium carbonate) crystals positioned within the flotation balloon.
Figure 6:
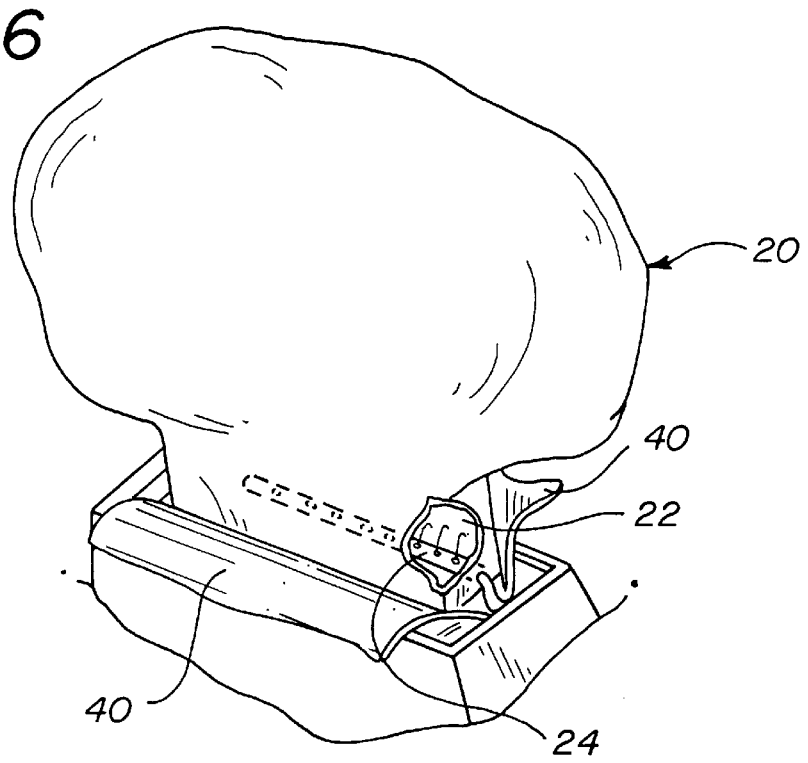
FIG. 6 is a partial perspective view of the exemplary emergency flotation device of FIG. 1 showing the scored flotation balloon retaining membrane forced in half by the inflated flotation balloon and a portion of the inflated flotation balloon cutaway to show acid solution being dispensed from the acid solution delivery tube onto the baking soda or calcium carbonate crystals positioned within the flotation balloon.

FIG. 5 is a schematic representation of the interconnections between the operational elements of emergency flotation device 10 (FIG. 1). In this embodiment, emergency flotation device 10 (FIG. 1) includes a flotation balloon inflation system, generally designated 50 that includes resilient bladder 16 filled with a supply of acetic acid (vinegar) 15; flexible tube 18 connecting resilient bladder 16 and the valve intake 52 of valve assembly 14; acid solution delivery tube 24 connected to the valve output 54 of valve assembly 14; and the calcium carbonate crystals 23 positioned within balloon chamber 22. In this embodiment, valve assembly 14 is a conventional pressure actuated valve having a manual D-ring actuator 60 (FIG. 2) for manual actuation of the valve in the event the pressure activated actuator fails. Operation of emergency flotation device 10 is now described with general reference to FIGS. 1–6. Emergency flotation device 10 is placed over the wrist of a user and locked closed as previously described.

Valve assembly 14 is actuated when the user's wrist is submerged under at least one foot of water. Actuation of valve assembly 14 creates a path between resilient bladder 16 and acid solution delivery tube 24 and releases a quantity of the acetic acid 15 into balloon chamber 22. When acetic acid 15 contacts calcium carbonate crystals 23, carbon dioxide gas is generated in sufficient volume to, with reference to FIG. 6, rupture balloon retaining membrane 40 and allow flotation balloon 20 to deploy from flotation balloon storage compartment 46 (FIG. 4).

It can be seen from the preceding description that an emergency flotation device has been provided that is of a size small enough to be worn without greatly hindering the activities of the wearer; that is securable about the wrist of the user; that includes a flotation balloon that is inflatable by a gas; that includes a chemical gas generating system and an inflatable flotation balloon that is inflated by the chemically generated gas; and that includes a bracelet assembly including an upper bracelet member and a lower bracelet member that are attached by a flexible bracelet member hinge, that are pivotable into a closed position forming a wrist receiving opening, and that are securable in the closed position by a bracelet member latch, the upper bracelet member having a flotation balloon storage compartment formed therein in connection with a flotation balloon deployment window, the lower bracelet member having a bladder receiving compartment formed therein; a scored flotation balloon retaining membrane positioned over the flotation balloon deployment window of the upper bracelet member; a valve assembly having a valve intake, a valve outlet and a manually activated valve positioned between the valve intake and the valve outlet; a resilient bladder filled with a pressurized acid solution, the resilient bladder being positioned within the bladder receiving compartment of the lower bracelet member; a flexible connecting tube in connection between the resilient bladder and the valve intake; an inflatable flotation balloon positioned within the flotation balloon receiving compartment of the upper bracelet member, the inflatable flotation balloon having a balloon chamber having a supply of calcium carbonate positioned therein; and an acid solution delivery tube in connection between the valve outlet and the balloon chamber of the inflatable flotation balloon.

It is noted that the embodiment of the emergency flotation device described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. An emergency flotation device comprising:

a bracelet assembly including an upper bracelet member and a lower bracelet member that are attached by a flexible bracelet member hinge, that are pivotable into a closed position forming a wrist receiving opening, and that are securable in said closed position by a bracelet member latch, said upper bracelet member having a flotation balloon storage compartment formed therein in connection with a flotation balloon deployment window, said lower bracelet member having a bladder receiving compartment formed therein; a scored flotation balloon retaining membrane positioned over said flotation balloon deployment window of said upper bracelet member;

a valve assembly having a valve intake, a valve outlet and a manually activated valve positioned between said valve intake and said valve outlet;

a resilient bladder filled with a pressurized acid solution, said resilient bladder being positioned within said bladder receiving compartment of said lower bracelet member;

a flexible connecting tube in connection between said resilient bladder and said valve intake;

an inflatable flotation balloon positioned within said flotation balloon receiving compartment of said upper bracelet member, said inflatable flotation balloon having a balloon chamber having a supply of carbon dioxide generating crystals positioned therein; and an acid solution delivery tube in connection between said valve outlet and said balloon chamber of said inflatable flotation balloon.

2. The emergency flotation device of claim 1, wherein:

said acid solution is vinegar.

3. The emergency flotation device of claim 1, wherein:

said carbon dioxide generating crystals include calcium carbonate.

4. The emergency flotation device of claim 1 wherein:

said carbon dioxide generating crystals include sodium bicarbonate.

5. The emergency flotation device of claim 1 wherein:

said inflatable flotation balloon is stored within said flotation balloon storage compartment in a folded configuration.

6. The emergency flotation device of claim 2, wherein:

said carbon dioxide generating crystals include calcium carbonate.

7. The emergency flotation device of claim 2 wherein:

said carbon dioxide generating crystals include sodium bicarbonate.

8. The emergency flotation device of claim 2 wherein:

said inflatable flotation balloon is stored within said flotation balloon storage compartment in a folded configuration.

9. The emergency flotation device of claim 6 wherein:

said inflatable flotation balloon Is stored within said flotation balloon storage compartment in a folded configuration.

10. The emergency flotation device of claim 7 wherein:

said inflatable flotation balloon is stored within said flotation balloon storage compartment in a folded configuration.

11. The emergency flotation device of claim 3 wherein:

said inflatable flotation balloon is stored within said flotation balloon storage compartment in a folded configuration.

12. The emergency flotation device of claim 4 wherein:

said inflatable flotation balloon is stored within said flotation balloon storage compartment in a folded configuration.

* * * * *